US005217126A

United States Patent [19]

Hayashi et al.

[11] Patent Number: 5,217,126

[45] Date of Patent: Jun. 8, 1993

[54] SAFETY APPARATUS FOR CONSTRUCTION EQUIPMENT

[75] Inventors: Norihiko Hayashi, Akashi; Hideaki Yoshimatsu, Kobe, both of Japan

[73] Assignee: Kabushiki Kaisha Kobe Seiko Sho, Kobe, Japan

[21] Appl. No.: 964,040

[22] Filed: Oct. 21, 1992

[30] Foreign Application Priority Data

Oct. 24, 1991 [JP] Japan ..... 3-277714

[51] Int. Cl.[5] ..... B66C 13/16

[52] U.S. Cl. ..... 212/153; 212/189; 212/155

[58] Field of Search ..... 212/149, 150, 153, 154, 212/155, 189, 156

[56] References Cited

U.S. PATENT DOCUMENTS

| | | | |
|---|---|---|---|
| 4,198,857 | 4/1980 | Treux | 212/153 |
| 4,705,295 | 11/1987 | Fought | 212/189 |
| 4,860,539 | 8/1989 | Parrett et al. | 212/153 |
| 5,119,949 | 6/1992 | Kishi | 212/189 |
| 5,160,056 | 11/1992 | Yoshimatsu et al. | 212/153 |

*Primary Examiner*—Jesus D. Sotelo
*Assistant Examiner*—Stephen P. Avila
*Attorney, Agent, or Firm*—Oblon, Spivak, McClelland, Maier & Neustadt

[57] ABSTRACT

A safety apparatus which can set an appropriate rated load curve which can be grasped readily by an operator and takes a difference between horizontal extension amounts of outrigger jacks into consideration and can facilitate calculation of a load factor. Entire circumference load calculating means calculates a first rated load regarding a forward and backward direction and calculates a second rated load based on extended conditions of the front and rear outrigger jacks, and then calculates inflection angles of a rated load curve based on the rated loads and the extended conditions of the outrigger jacks, whereafter it sets, from the inflection angles, a final rated load curve which continues over the entire circumference. Further, load factor calculating means calculates a load factor making use of the rated load calculated by the entire circumference load calculating means, and a safety operation is performed in accordance with the load factor.

1 Claim, 14 Drawing Sheets

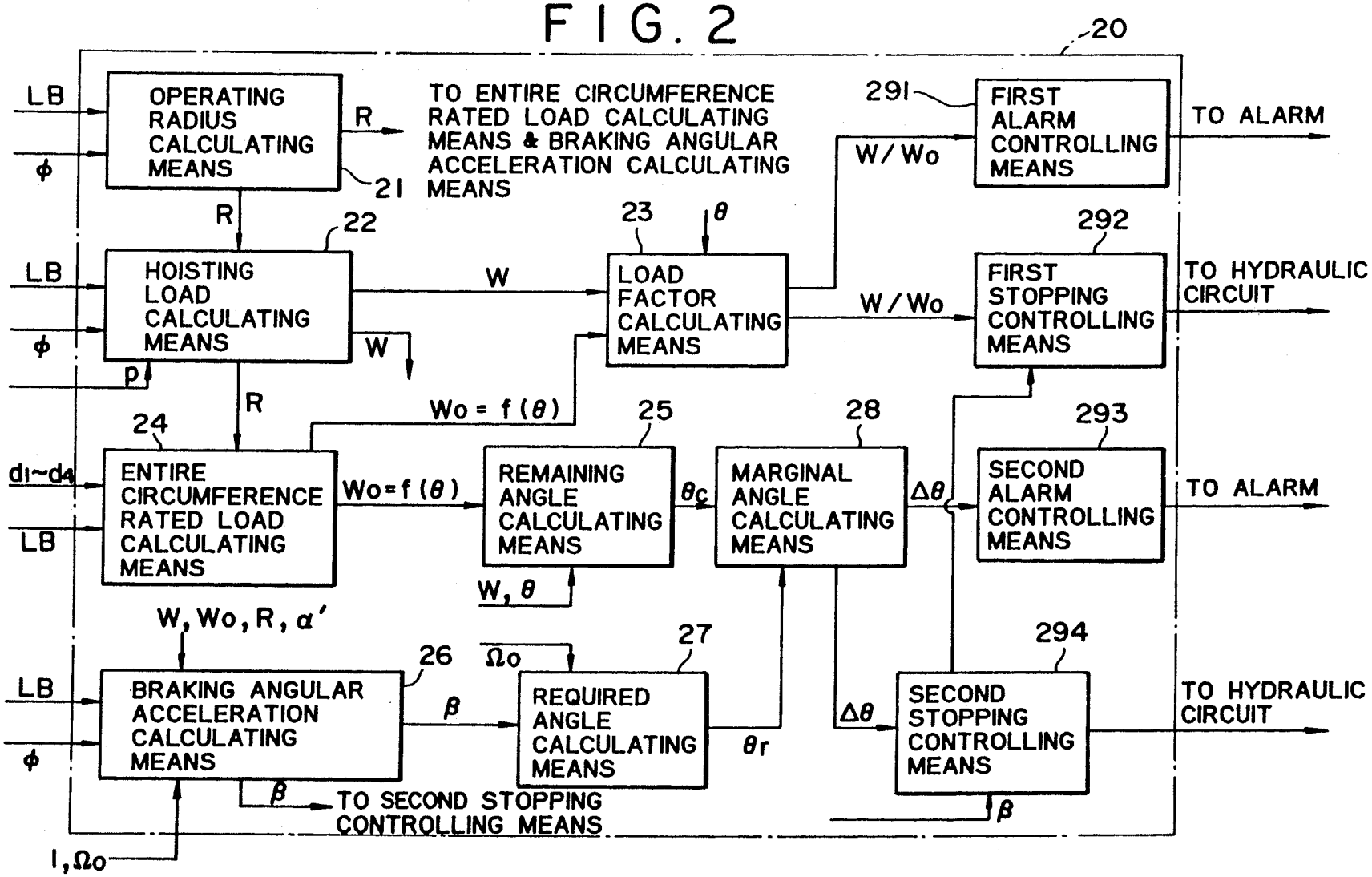
FIG. 2
20
TO ALARM
TO HYDRAULIC CIRCUIT
TO ALARM
TO HYDRAULIC CIRCUIT
FIRST ALARM CONTROLLING MEANS
291
FIRST STOPPING CONTROLLING MEANS
292
SECOND ALARM CONTROLLING MEANS
293
SECOND STOPPING CONTROLLING MEANS
294
W/Wo
W/Wo
Δθ
Δθ
β
MARGINAL ANGLE CALCULATING MEANS
28
θr
θc
TO ENTIRE CIRCUMFERENCE RATED LOAD CALCULATING MEANS & BRAKING ANGULAR ACCELERATION CALCULATING MEANS
θ
LOAD FACTOR CALCULATING MEANS
23
REMAINING ANGLE CALCULATING MEANS
25
REQUIRED ANGLE CALCULATING MEANS
27
W
Wo = f (θ)
W, θ
Ωo
R
21
W
22
Wo=f (θ)
β
26
OPERATING RADIUS CALCULATING MEANS
HOISTING LOAD CALCULATING MEANS
ENTIRE CIRCUMFERENCE RATED LOAD CALCULATING MEANS
24
W, Wo, R, α'
BRAKING ANGULAR ACCELERATION CALCULATING MEANS
TO SECOND STOPPING CONTROLLING MEANS
R
R
P
β
LB
φ
LB
φ
d1~d4
LB
LB
φ
l, Ωo

SAFETY APPARATUS FOR CONSTRUCTION EQUIPMENT

BACKGROUND OF THE INVENTION

1. Field of the Invention

This invention relates to a safety apparatus for a construction equipment such as a crane including a revolvable upper revolving member such as a boom which sets a rated load in accordance with extended conditions of support members of the construction equipment and performs a safety operation such as compulsory stopping of driving of the upper revolving member or alarming in accordance with the rated load.

2. Description of the Prior Art

Generally, in construction equipments of the type mentioned, it is important to prevent buckling, over turning and so forth during revolving operation, and to this end, various safety apparatus have been proposed wherein operation of an upper revolving member such as a boom is automatically stopped when the operating condition of the upper revolving member comes out of a safety region.

In conventional safety apparatus, an allowance requirement is set equally over the entire range of 360° irrespective of a revolving angle of the upper revolving member around its axis. However, since extendible support members such as outrigger jacks provided on a crane cannot always be extended completely horizontally and the horizontally extended amounts of the support members may be partially different depending upon an operating site such as a narrow road, the allowance requirement must necessarily be changed also depending upon the revolving angle of the upper revolving member.

A safety apparatus is disclosed in Japanese Patent Laid-Open Application No. 57-27893 wherein an operating condition of a crane is detected every moment and a rated load of the crane is decided from the detection value and preset values of the lifting capacity stored for various conditions, and then a safety operation is performed in accordance with a result of comparison between the rated load and an actual load.

Another safety apparatus is disclosed in Japanese Patent Laid-Open Application No. 3-115091 wherein a critical operating region of a boom is set in accordance with a horizontal extension amount of each support member and a safety operation is controlled in accordance with the critical operating region. The critical operating region may be set such that, where the horizontal extension amounts of the left and right support members are different from each other, a stable section and an unstable section are determined with regard to a revolving direction of the boom, and a first operating radius is set for the stable section while a second operating radius smaller than the first operating radius is set for a most unstable section within the unstable section and the operating radius is decreased continuously from the first operating radius to the second operating radius for any other section within the unstable section.

Since the apparatus disclosed in Japanese Patent Laid-Open Application No. 57-27893 calculates a rated load every moment in accordance with extended conditions of the outrigger jacks at present, a curve (rated load curve) which is obtained by interconnecting the rated loads at the various revolving angles calculated by the apparatus presents an irregular profile, and consequently, there is a disadvantage that it is difficult for the operator to grasp the curve. For example, in case the boom is revolved in a condition wherein the operating radius is fixed, the rated load is sometimes decreased suddenly even by a small change of the revolving angle, and the operator cannot forecast a variation of the rated load by revolving movement at all. Accordingly, very careful operation is required for the operator.

On the other hand, with the apparatus disclosed in Japanese Patent Laid-Open Application No. 3-115091, since an allowable operating radius is calculated from a hoisting load to the upper revolving member and an allowable operating range is set in accordance with the allowable operating radius, a critical operating region can be grasped comparatively readily. However, generally in a construction equipment such as a crane, it is strongly demanded to effect, for the purpose of safely, a safety operation (alarming, compulsory stopping, displaying of a load factor or the like) based on a load factor (ratio of the hoisting load to the rated load), and such safety operation is already carried out widely and commonly. In order to calculate a critical operating region with the apparatus described above, the relationship between an operating radius and a revolving angle when the hoisting load at present is equal to the rated load must be calculated, quite separately from the calculation of a load factor, every time from data of the rated load corresponding to extension amounts of the support members and/or an operating radius of the upper revolving member. Thus, there is a disadvantage that the calculating apparatus is complicated as much and the necessary capacity is increased as much.

It is to be noted that, while an apparatus is proposed in Japanese Patent Laid-Open Application No. 3-73795 wherein a load factor is calculated over the entire circumference of an upper revolving member and is displayed as a load factor image, what calculation of a load factor is performed concretely in accordance with an operating posture of a crane is not disclosed in the prior art document. Accordingly, the apparatus does not make a solution to the subject described above.

SUMMARY OF THE INVENTION

It is an object of the present invention to provide a safety apparatus for a construction equipment such as a crane which can use same data as data for conventional calculation of a load factor without requiring special calculations in finding out both of a load factor and an operation allowance region.

It is another object of the present invention to provide a safety apparatus for a construction equipment such as a crane which can set an operation allowance region which is simple in profile and easy for a user to grasp and appropriately takes a difference between horizontal extension amounts of support members into consideration.

In order to attain the objects, according to the present invention, there is provided a safety apparatus for a construction equipment which includes a revolvable upper revolving member and a plurality extendible support members and wherein a hoisting load is suspended at a predetermined position of the upper revolving member, comprising hoisting load detecting means for detecting a hoisting load to the upper revolving member, operating radius detecting means for detecting an operating radius of the upper revolving member, revolving angle detecting means for detecting a revolving angle of the upper revolving member, support member detecting means for detecting a horizontal extension amount of each of the support members, entire circumference rated load calculating means for calculating rated loads of the upper revolving member in accordance with the operating radius and the horizontal extension amounts of the support members for different revolving angles and setting a rated load curve over the entire circumference, load factor calculating means for calculating a load factor in accordance with the rated load calculated by the entire circumference rated load calculating means, first operating means for performing a safety operation in accordance with the load factor calculated by the load factor calculating means, and second operating means for performing a safety operation in accordance with the rated load curve set by the entire circumference rated load calculating means and an actual hoisting load and an actual revolving angle of the upper revolving member, and wherein the entire circumference rated load calculating means includes forward capacity calculating means for calculating a first rated load of the upper revolving member with regard to the forward and backward direction, sideward capacity calculating means for calculating second rated loads of the upper revolving member individually with regard to the left and right sides in accordance with extended conditions of the support members, and rated load setting means for setting a rated load curve, which continues over the entire circumference, in accordance with the first rated load, the second rated load and the extended conditions of the individual support members.

Here, "a safely operation based on a load factor" may be, in addition to an alarming operation or a compulsory stopping operation in accordance with a concrete value of the load factor, an operation of displaying the load fact as it is on the outside and so forth.

In the safety apparatus for a construction equipment, a first rated load which defines a forward capacity and a second rated load which defines a sideward capacity are determined in accordance with horizontal extension amounts of the front and rear, left and right support members, and a final rated load curve which continues over the entire circumference is set in accordance with the first and second rated loads. Further, when a load factor is calculated by the load factor calculating means, results of calculation by the entire circumference rated load calculating means can be utilized as they are.

With the safety apparatus for a construction equipment, since a forward capacity, i.e., a first rated load regarding the forward and rearward direction, is calculated and sideward capacities, i.e., second rated loads regarding sidewards, are calculated individually for the opposite left and right sides in accordance with extended conditions of the support members and then inflection angles of a rated load curve are calculated from the first and second rated loads and the extended conditions of the support members, whereafter a rated load curve which continues over the entire circumference is finally set from the deflection angles, a rated load curve which takes horizontal extension amounts of the front and rear support members into consideration and can be grasped readily by an operator can be set, and consequently, enhancement of the operability of the safety apparatus can be achieved while assuring safety of the construction equipment. Besides, when a load factor is to be calculated and a safety operation is to be performed in accordance with the calculation, the rated loads calculated by the entire circumference rated load calculating means can be utilized as they are. Consequently, there is an advantage that the calculating apparatus can be simplified and the necessary capacity thereof can be reduced.

The above and other objects, features and advantages of the present invention will become apparent from the following description and the appended claims, taken in conjunction with the accompanying drawings in which like parts or elements are denoted by like reference characters.

BRIEF DESCRIPTION OF THE DRAWINGS

FIG. 2 is a block diagram showing function blocks of the calculating and controlling unit of FIG. 1;

DETAILED DESCRIPTION OF THE PREFERRED EMBODIMENT

Figure 15:
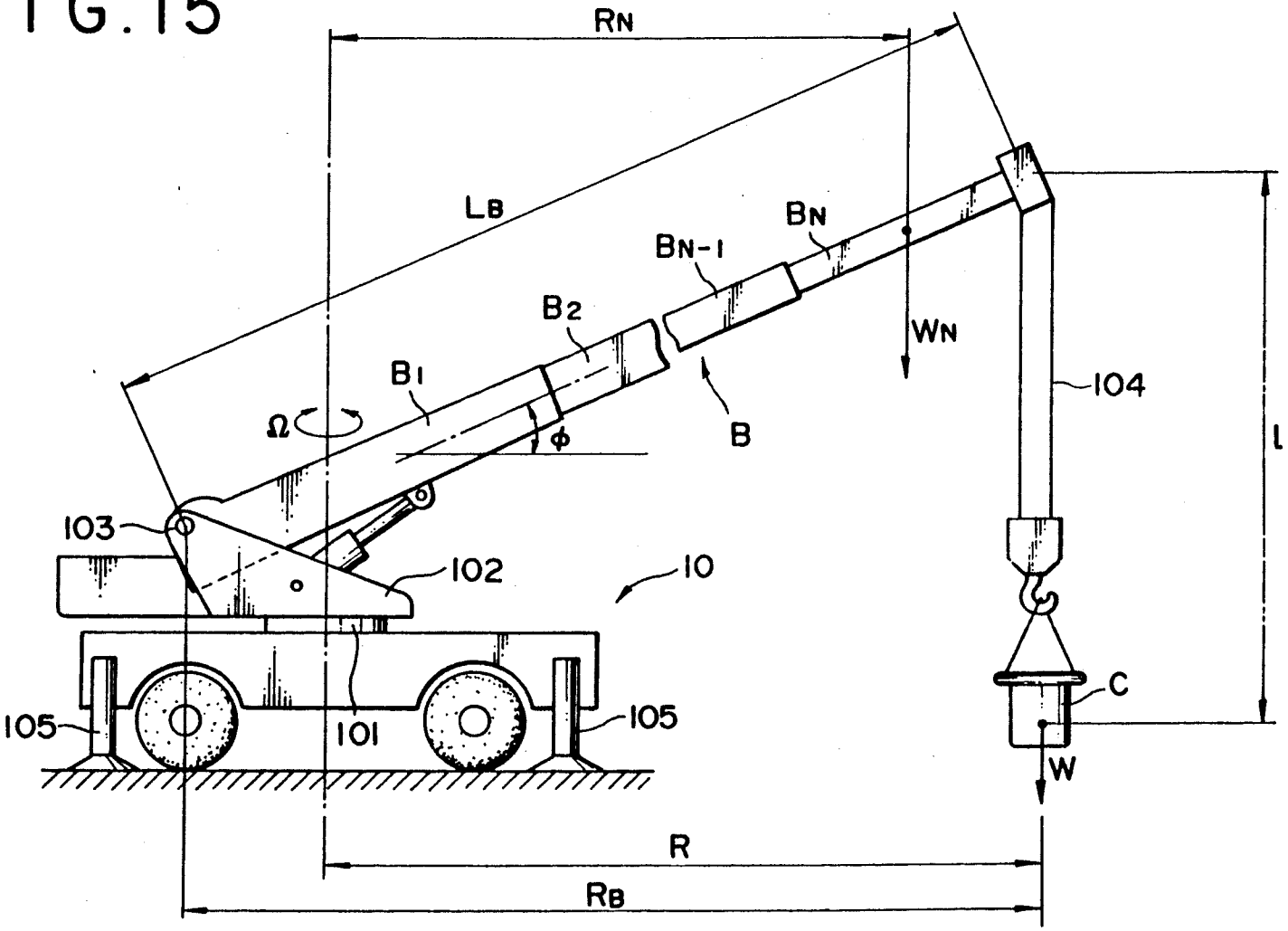
FIG. 15 is a side elevational view of a crane to which the safety apparatus of the present invention is incorporated.

Referring first to FIG. 15, there is shown a crane as a construction equipment in which a safety apparatus according to the present invention is incorporated. The crane shown is generally denoted at 10 and includes a boom foot 102 revolvable around a vertical shaft 101 and serving as an upper revolving member, and an expansible boom B composed of N boom members $B_1$ to $B_N$ and mounted on the boom foot 102. The boom B is mounted for pivotal motion (upward and downward movement) around a horizontal shaft 103, and a suspended load C is suspended at an end (boom point) of the boom B by way of a rope 104. It is to be noted that Bn (n=1, 2, . . . , N) in the following description denotes an nth boom member as counted from the boom hoot 102 side.

Outrigger jacks 105 serving as support members are disposed at the four front and rear, left and right corners of a lower frame of the crane 10 and extend horizontally sidewardly. The horizontal extension amount of each of the outrigger jacks 105 can be set individually.

Figure 1:
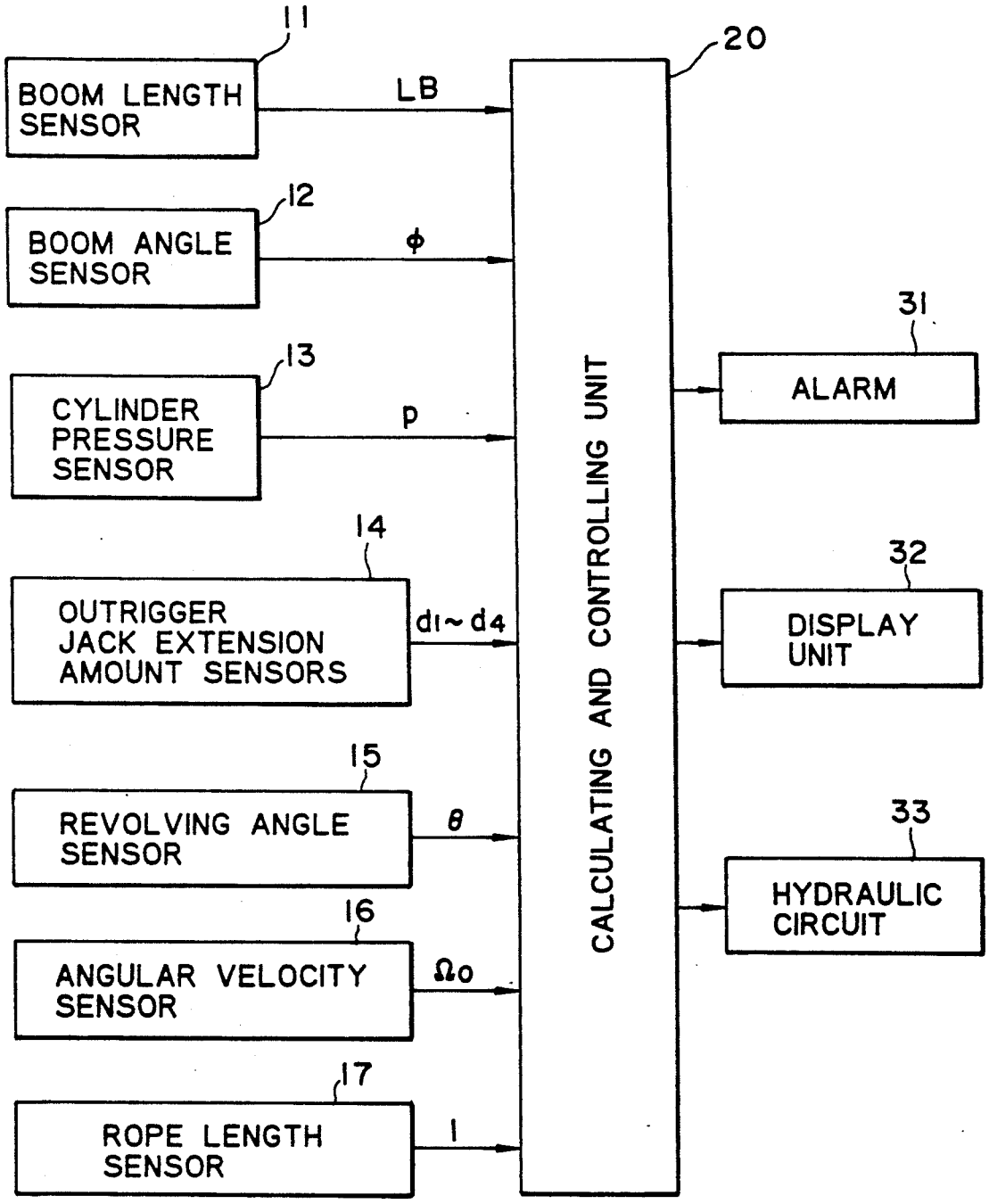
FIG. 1 is a block diagram of hardware construction of inputs and outputs of a calculating and controlling unit of a safety apparatus for a crane showing an embodiment of the present invention.

Referring also to FIG. 1, a boom length sensor 11, a boom angle sensor 12, a cylinder pressure sensor 13, four outrigger jack horizontal extension amount sensors 14, a revolving angle sensor 15, a revolving angular velocity sensor 16 and a rope length sensor 17 are disposed on the crane 10, and detection signals of the sensors 11 to 17 are inputted to a calculating and controlling unit 20. Controlling signals are outputted from the calculating and controlling unit 20 to an alarm 31, a display unit 32 having a display screen and a hydraulic circuit 33 for driving the boom B to revolve.

Referring now to FIG. 2, there is shown functional construction of the calculating and controlling unit 20. The calculating and controlling unit 20 is constructed to execute two controls roughly of 1) calculation and control regarding a load factor, and 2) calculation and control regarding a rated load curve.

1) Functional Construction Regarding Calculation and Control of Load Factor

The calculating and controlling unit 20 includes operating radius calculating means 21 which calculates an operating radius R of a suspended load C from a boom length LB and a boom angle $\phi$ detected by the boom length sensor 11 and the boom angle sensor 12, respectively. Hoisting load calculating means 22 constituting hoisting load detecting means calculates a load W provided by an actually hoisted suspended load C from the boom length LB, the boom angle $\phi$ and a cylinder pressure p of a boom upper element detected by the cylinder pressure sensor 13.

Load factor calculating means 23 calculates, based on the hoisting load W of the boom B calculated by the hoisting load calculating means 22, a revolving angle $\theta$ detected by the revolving angle sensor 15 and a rated load Wo regarding the revolving angle $\theta$ calculated by entire circumference rated load calculating means 24 which will be hereinafter described, a ratio of the actual hoisting load W to the rated load Wo, that is, a load factor W/Wo.

First alarm controlling means 291 serving as first operating means outputs, at a point of time when the load factor W/Wo calculated by the load factor calculating means 23 becomes higher than 90%, a controlling signal to the alarm 31 so as to effect alarming. First stopping controlling means 292 serving as first operating means outputs, at a point of time when the load factor W/Wo exceeds 100%, a controlling signal to the hydraulic circuit 33 so as to compulsorily stop an operation of the crane except a revolving operation.

By the means described above, calculation of a load factor W/Wo and control of a safety operation based on the load factor W/Wo is performed.

2) Functional Construction Regarding Calculation and Control of Rated Load Curve The entire circumference rated load calculating means 24 calculates an entire circumference rated load of the crane 10, that is, a load (rated load) Wo of a range within which it is safe with the operating radius R then for all of revolving angles $\theta$ based on the operating radius R and horizontal extension amounts $d_1$ to $d_4$ of the individual outrigger jacks 105 detected by the outrigger jack horizontal extension amount sensors 14. More particularly, referring to FIG. 3, the entire circumference rated load calculating means 24 includes forward capacity calculating means 241, outrigger jack mode discriminating means 242, sideward capacity calculating means 243, compression calculating means 244, inflection angle calculating means 245, interpolation calculating means 246 constituting rated load setting means and rated load setting means 247. The rated load Wo set here is given by a relational expression $Wo=f(\theta)$ to the revolving angle $\theta$.

Referring back to FIG. 3, remaining angle calculating means 25 calculates a remaining angle $\theta c$ over which the boom B can be revolved until it reaches from its current position to a rated load curve.

Figure 4:
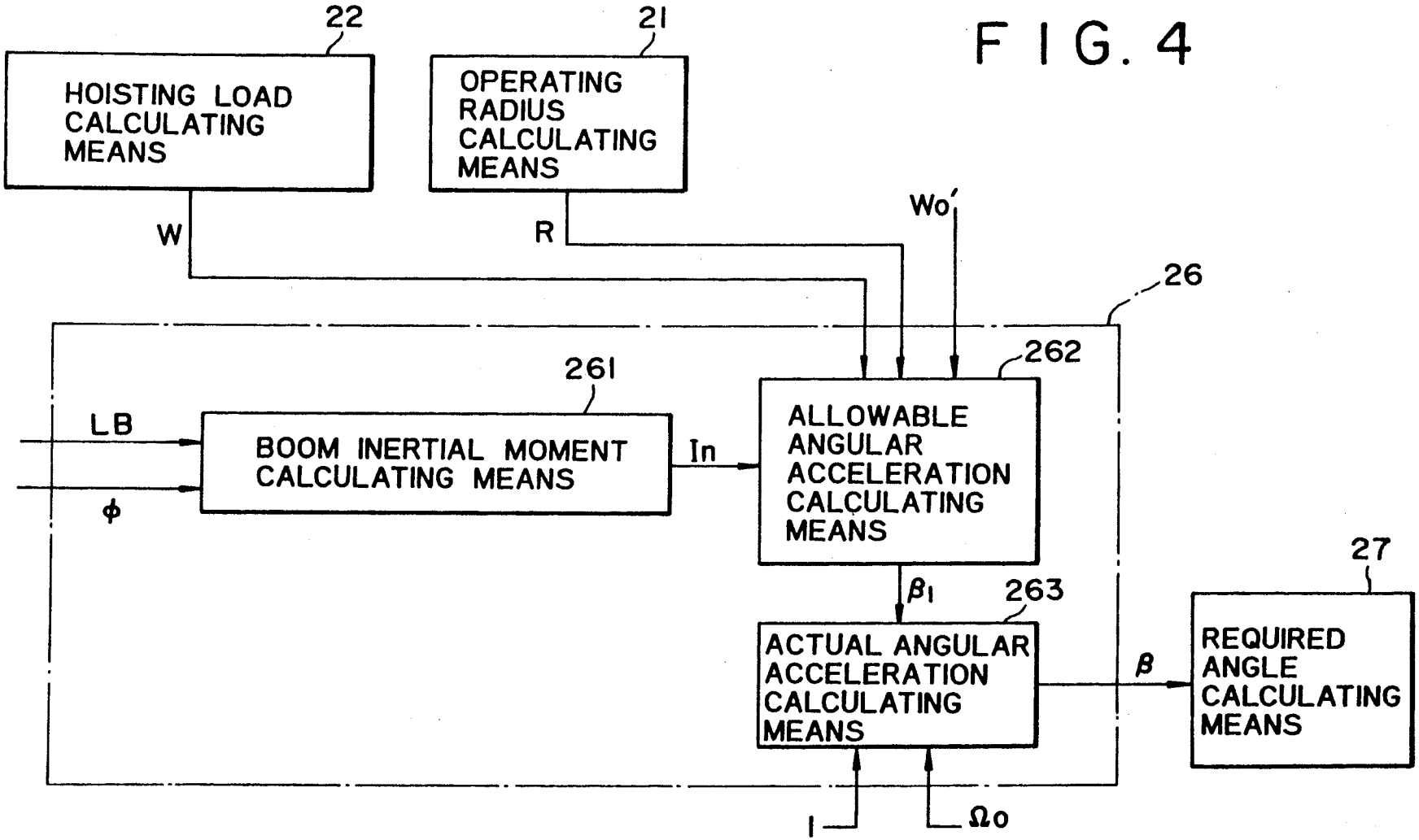
FIG. 4 is a block diagram showing function blocks of braking angular acceleration calculating means of the calculating and controlling unit of FIG. 1.
Figure 5:
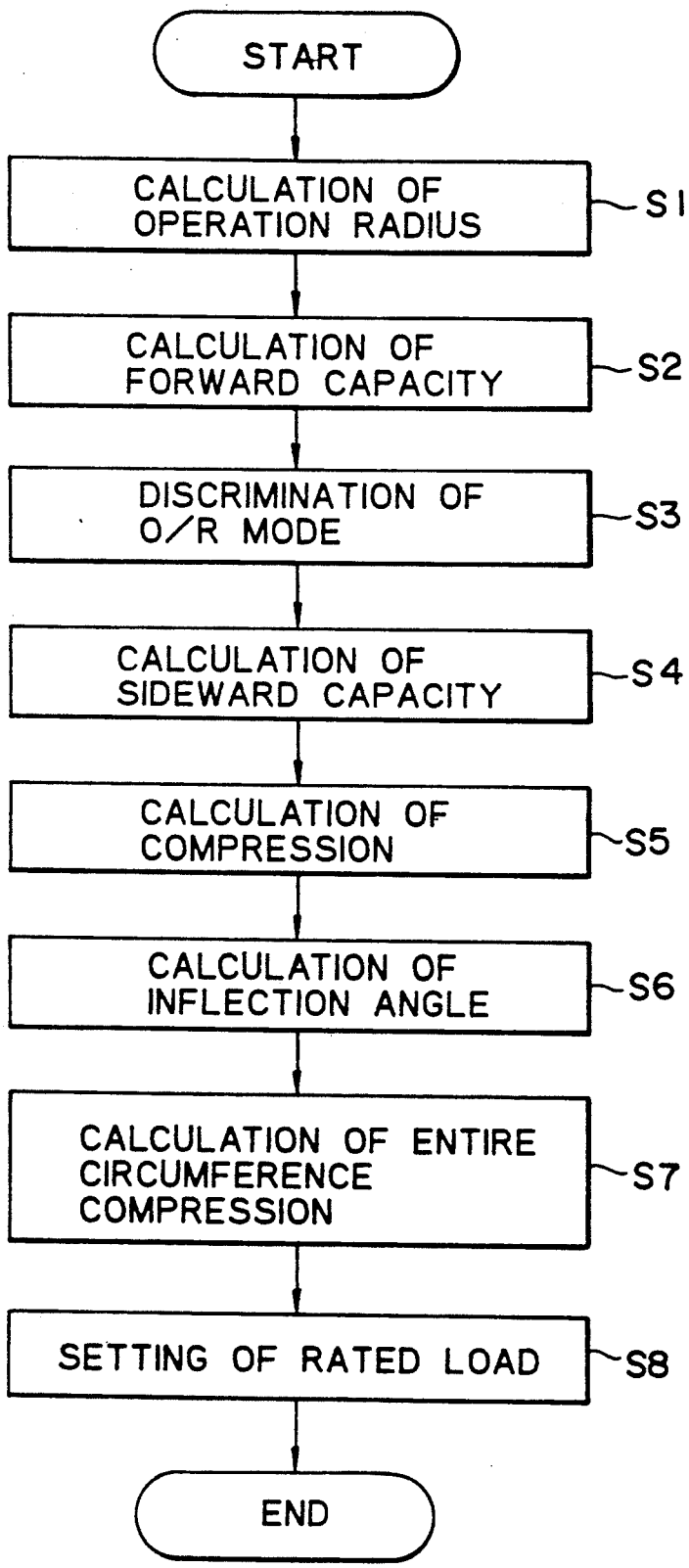
FIG. 5 is a flow chart illustrating calculating operation of the entire circumference rated load calculating means shown in FIG. 3.

Braking angular acceleration calculating means 26 calculates an actual braking angular acceleration $\beta$ from the operating radius R, the boom length LB, the boom angle $\phi$ and an angular velocity $\Omega o$ and a swinging diameter 1 of a hoisting load detected by the angular velocity sensor 16 and the rope length sensor 17, respectively. More particularly, referring to FIG. 4, the braking angular acceleration calculating means 26 includes boom inertial moment calculating means 261, allowable angular acceleration calculating means 262 and actual angular acceleration calculating means 263, and calculates a braking angular acceleration $\beta$ which does not cause swinging movement of the suspended load C upon stopping of revolving movement and takes a lateral bending strength of the boom B against an inertial force upon compulsory stopping into consideration.

Referring back to FIG. 2, required angle calculating means 27 calculates, based on an angular velocity $\Omega o$ before starting of braking to revolving movement, an angle (required angle) $\theta r$ over which the boom B is revolved until it stops after starting of braking at the braking angular acceleration $\beta$. Marginal angle calculating means 28 calculates a marginal angle $\Delta\theta$ which is a difference between the remaining angle $\theta c$ and the required angle $\theta r$.

Second alarm controlling means 293 second operating means outputs, at a point of time when the calculated marginal angle $\Delta\theta$ becomes lower than a predetermined value, a controlling signal to the alarm 31 to effect alarming. Second stopping controlling means 294 second operating means outputs, at a point of time when the marginal angle $\Delta\theta$ becomes equal to 0, a controlling signal to cause a motor in the hydraulic system 33 to be braked and stop revolving movement of the boom B at the braking angular acceleration $\beta$ and sends another signal to the first stopping controlling means 292 to compulsorily stop any operation thereof in which the operating radius R is further increased from the point of time.

By the means described above, a rated load curve over the entire circumference is set, and a safety operation is controlled in accordance with a result of comparison between the rated load curve and an operating condition at present.

Subsequently, contents of calculation and contents of control actually executed by the calculating and controlling unit 20 will be described.

1) Calculation and Control Regarding Load Factor

The operating radius calculating means 21 first calculates an operating radius R', which does not take a deflection of the boom B into consideration, from a boom length LB and a boom angle $\phi$ and calculates an error $\Delta R$ caused by a deflection of the boom B, and then calculates an operating radius R from the operating radius R' and the error $\Delta R$. The hoisting load calculating means 22 calculates a load W of an actually hoisted suspended load C from the thus calculated operating radius R, the boom length LB and the cylinder pressure p. The entire circumference rated load calculating means 24 calculates a rated load Wo in the form of a function $f(\theta)$ of the revolving angle over the entire circumference in such a manner as hereinafter described from the operating radius R at present, horizontal extension amounts $d_1$ to $d_4$ of the outrigger jacks 105 and so forth. Further, the load factor calculating means 23 calculates a load factor W/Wo from a rated load Wo corresponding to the current revolving angle $\theta$ and the hoisting load W.

In case the load factor W/Wo is higher than 90%, an alarm is issued from the alarm 31 which has received an output signal of the first alarm controlling means 291, and consequently, the operator can become aware that the load W by the hoisted load C is in the proximity of the rated load Wo. Further, when the load factor W/Vo exceeds 100%, that is, when the actual load W is higher than the rated load Wo, operation of the crane except revolving movement, that is, extending or upward or downward movement of the boom B, lifting operation of the suspended load C or the like, is compulsorily stopped in response to an output signal of the first stopping controlling means 292 in order to prevent a risk.

2) Calculation and Control Regarding Rated Load Curve

The entire circumference rated load calculating means 24 sets a rated load curve in accordance with the horizontal extension amounts $d_1$ to $d_4$ of the outrigger jacks 105.

A setting operation of the entire circumference rated load calculating means 24 will be described with reference to FIGS. 3, 5 and 6 to 11.

Figure 3:
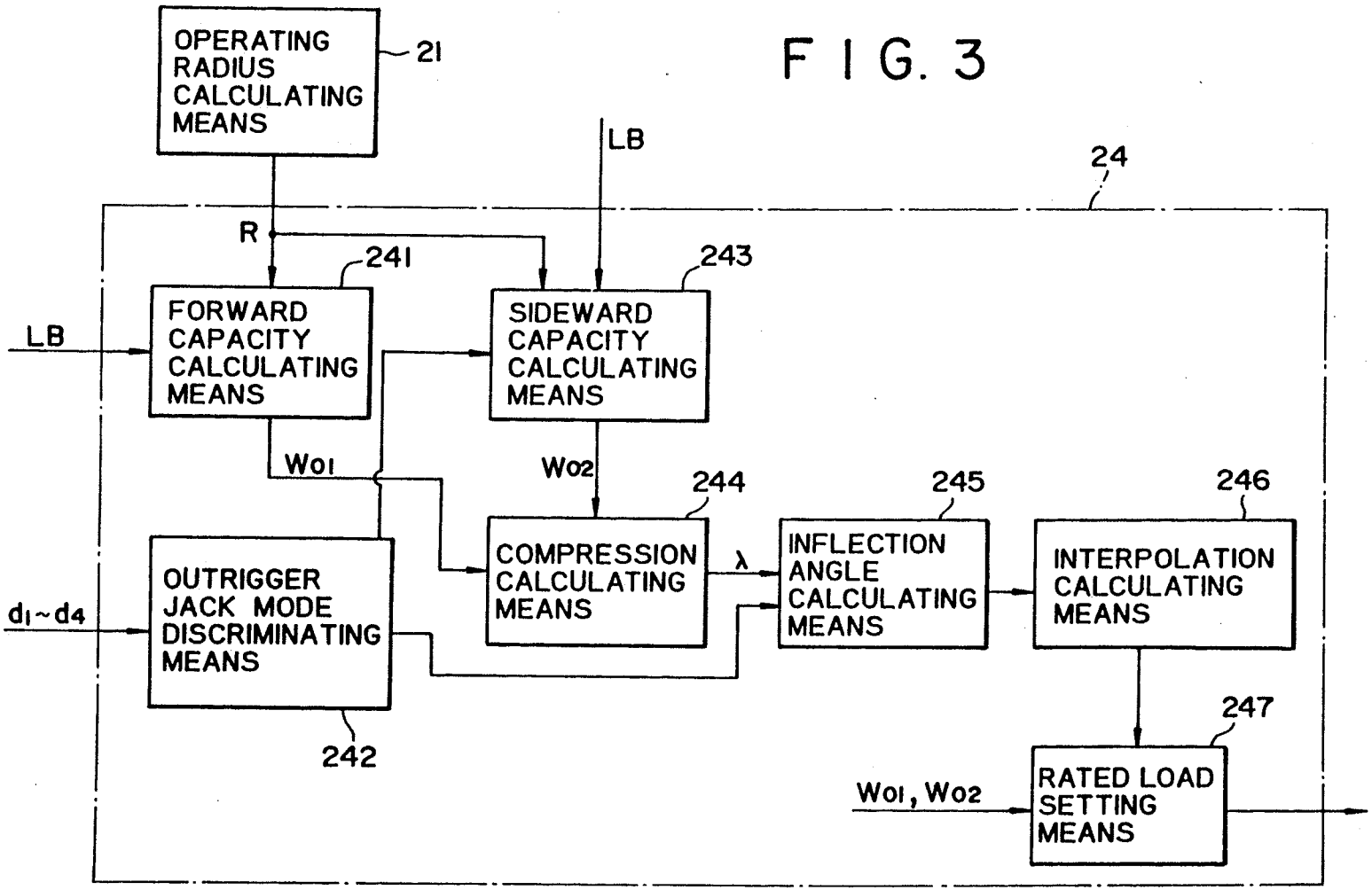
FIG. 3 is a block diagram showing function blocks of entire circumference rated load calculating means of the calculating and controlling unit of FIG. 1.

First, an operating radius R is calculated (step S1 of FIG. 5) by the operating radius calculating means 21, and then the forward capacity calculating means 241 shown in FIG. 3 first calculates, based on the operating radius R, a rated load (first rated load) $W_{01}$ when the boom B extends in the forward and backward direction, which is a parameter representative of a forward capacity of the crane. It is to be noted that it is determined by calculation of an inflection angle hereinafter described a region to which position should be determined as a forward (backward) range of the crane and a region to which position should be determined as a sideward range of the crane.

Figure 6:
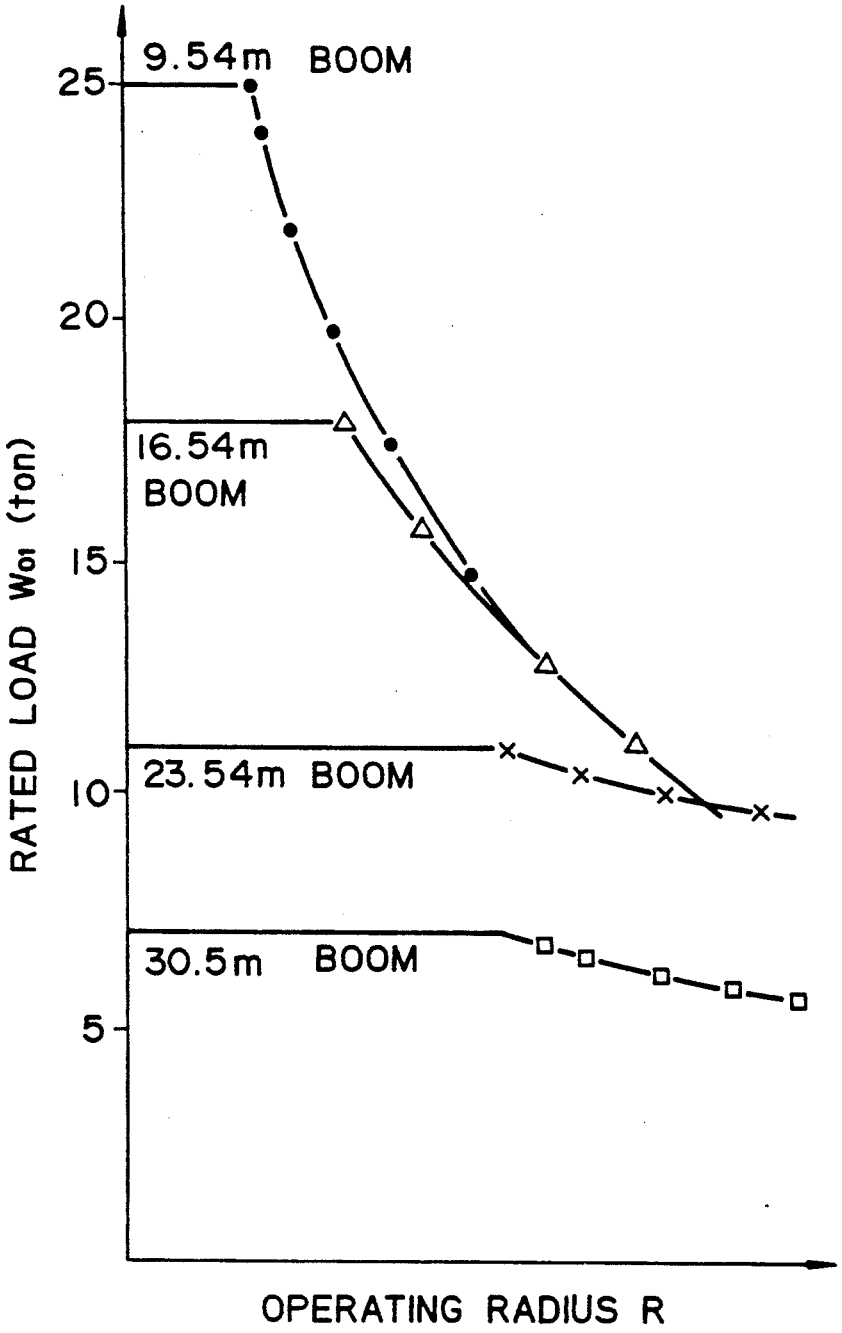
FIG. 6 is a graph illustrating a relationship between an operating radius and a hoisting load stored in the entire circumference rated load calculating means shown in FIG. 3.
Figure 7:
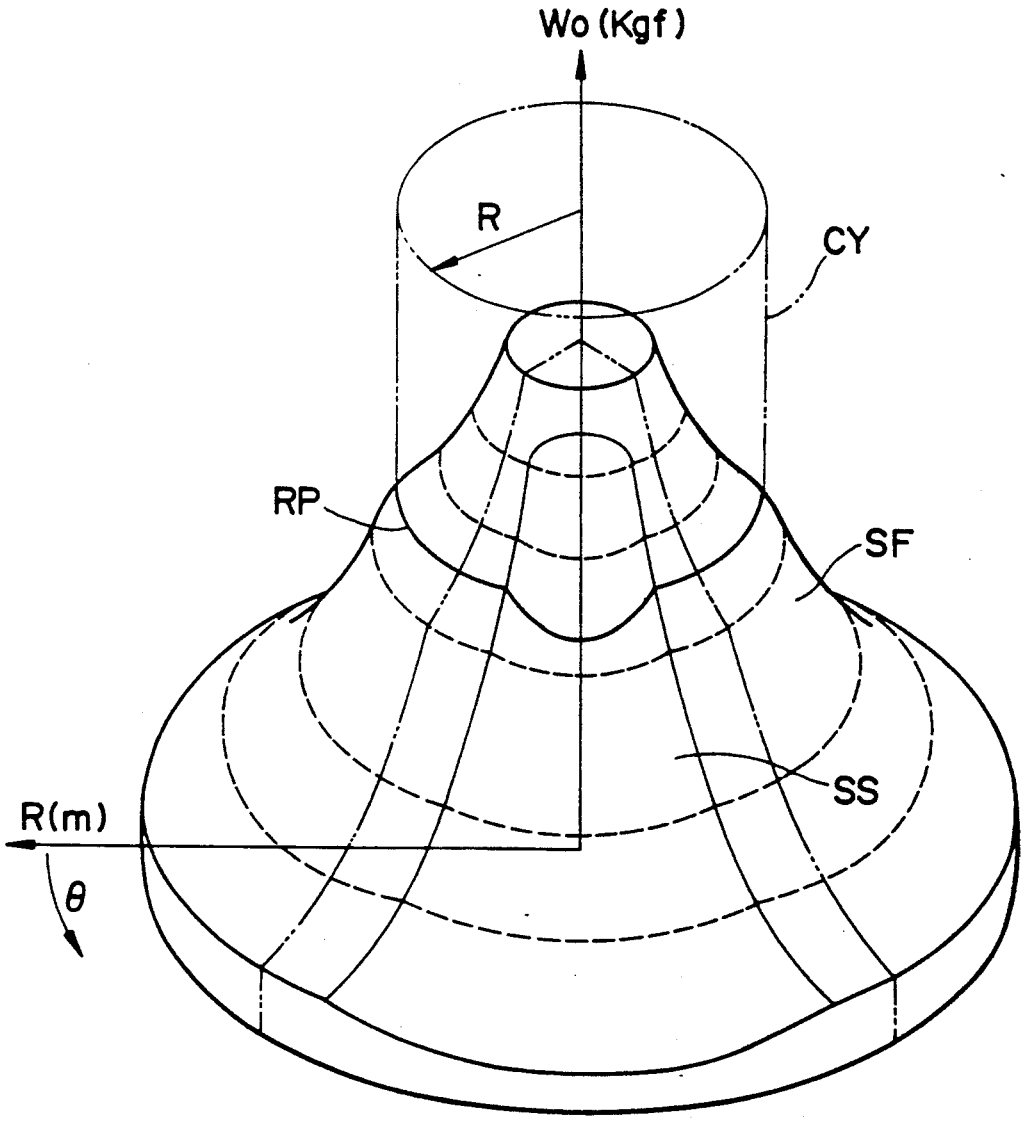
FIG. 7 is a graph illustrating interpolating calculating operation of a rated load executed by the entire circumference rated load calculating means shown in FIG. 3.
Figure 8:
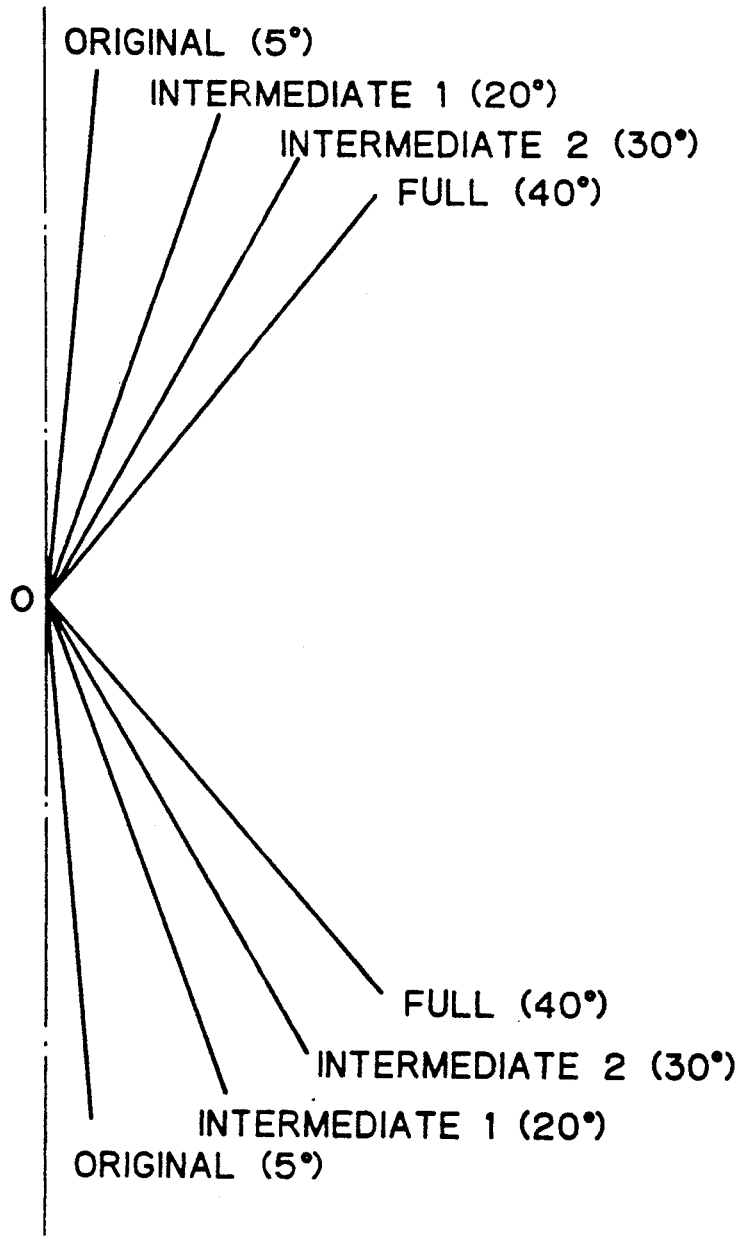
FIG. 8 is a diagrammatic view illustrating a relationship between horizontal extension amounts of outrigger jacks and a first inflection angle.

The first rated load $W_{01}$, which defines the forward capacity of the crane, is decided independently of horizontal extension amounts of the outrigger jacks 105. In the present embodiment, the forward capacity calculating means 241 stores rated loads $W_{01}$ corresponding to the operating radius R for four boom lengths LB as shown in FIG. 6, and a first rated load $W_{01}$ suitable for the boom length LB and the rated load R at present is calculated based on the data. It is to be noted that, when the actual boom length LB does not correspond to any of the four boom lengths and has an intermediate value among them, a suitable value $W_{01}$ is calculated by linear interpolation calculation from values corresponding to two boom lengths between which the value is positioned.

Meanwhile, at the outrigger jack mode discriminating means 242, discrimination of an outrigger jack mode (outrigger jack extended condition) at present is performed individually for both of the left and right sides of the crane (step S3). The horizontal extension amount of each of the outrigger jacks 105 can be changed over among four amounts including its original amount (not extended), an intermediate amount 1 (a smaller intermediate extension amount), another intermediate amount 2 (a greater intermediate extension amount) and a full extension amount as shown also in FIG. 8, and accordingly, the outrigger jack mode corresponds to one of 10 modes listed in Table 1 below.

TABLE 1

| Mode | Front Outrigger Jack Extension | Rear Outrigger Jack Extension | Remarks |
|---|---|---|---|
| 1 | Full | Full | |
| 2 | Full | Intermediate 2 | |
| 3 | Full | Intermediate 1 | |
| 4 | Full | Original | |
| | Intermediate 2 | Full | Reverse to Mode 2 |
| 5 | Intermediate 2 | Intermediate 2 | |
| 6 | Intermediate 2 | Intermediate 1 | |
| 7 | Intermediate 2 | Original | |
| | Intermediate 1 | Full | Reverse to Mode 3 |
| | Intermediate 1 | Intermediate 2 | Reverse to Mode 6 |
| 8 | Intermediate 1 | Intermediate 1 | |
| 9 | Intermediate 1 | Original | |
| | Original | Full | Reverse to Mode 4 |
| | Original | Intermediate 2 | Reverse to Mode 7 |
| | Original | Intermediate 1 | Reverse to Mode 9 |
| 10 | Original | Original | |

Subsequently, the sideward capacity calculating means 243 calculates a rated load (second rated load) $W_{02}$ when the boom B extends in the leftward and rightward direction, which is a parameter of the sideward capacity, from the operating radius R and the outrigger jack mode described above (step S4). More particularly, the sideward capacity calculating means 243 has stored therein data similar to the data of the graph shown in FIG. 6, that is, rated loads $W_{02}$ corresponding to the operating radius R, individually for the 10 outrigger jack modes described above and sets a second rated load $W_{02}$ based on the data. The second rated load $W_{02}$ is naturally lower than the first rated load $W_{01}$ described above, but the second rated load $W_{02}$ is not a value which depends upon factors of strength of various portions of the crane but is a value which depends mainly upon factors restricted from over turning of the crane caused by shortage in outrigger jack extension amount.

Subsequently, from the two rated loads $W_{02}$ and $W_{01}$, a compression, which is a ratio $W_{02}/W_{01}$ between them, is calculated by the compression calculating means 244 (step S5). Then, an inflection angle of a rated load curve is calculated from the compression $\lambda$ and the outrigger jack mode (step S6).

The inflection angle signifies a revolving angle at which, when a rated load curve is to be set, the curve changes from an arc having a radius equal to a rated load to a straight line or from a straight line to an arc. The inflection angle set here is roughly divided into four front and rear, left and right first inflection angles $\theta_{F1}$ and $\theta_{R1}$ (which are set without fail) which make boundaries between the forward and backward regions and the leftward and rightward regions of the crane, and second inflection angles $\theta_{F2}$ and $\theta_{R2}$ (which may or may not be set) which are set between the front and rear first inflection angles.

First, the front side first inflection angle $\theta_{F1}$ and the rear side first inflection angle $\theta_{R1}$ are determined in a simple one by one corresponding relationship to the front side outrigger jack horizontal extension amount and the rear side outrigger jack horizontal extension amount, respectively. For example, if it is assumed that the front of the crane is determined as $\theta=0°$ and the horizontal extension amount of the front side outrigger jacks 105 is the "original" while the horizontal extension amount of the rear side outrigger jacks 105 is the "intermediate 2", then the front side first inflection angle $\theta_{F1}$ is set to 5° while the rear side first inflection angle $\theta_{R1}$ is set to $180°-30°=150°$.

Figure 9:
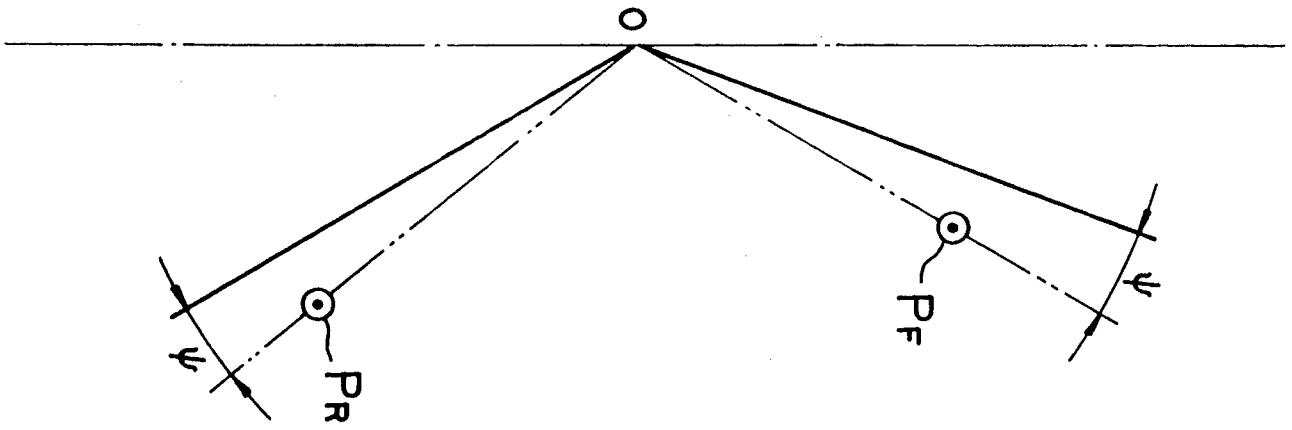
FIG. 9 is a similar view but illustrating another setting method of a first inflection angle.

It is to be noted that, in a machine wherein the outrigger jack horizontal extension amount can be adjusted in an analog fashion, as shown in FIG. 9, angles displaced by a certain adjusting angle $\phi$ from angles of straight lines drawn from the center 0 of the crane to the extension points PF and PR of the outrigger jacks may be determined as first inflection angles.

The operating region of the crane is divided into front and rear regions and left and right regions by the first inflection angles $\theta_{F1}$ and $\theta_{R1}$, and for the front and rear regions, arcs having the fist rated load $W_{01}$ described above make rated load curves as they are.

Subsequently, as for the left and right regions, it is first judged whether or not second inflections angles $\theta_{F2}$ and $\theta_{R2}$ should be set in those regions.

Figure 10A:
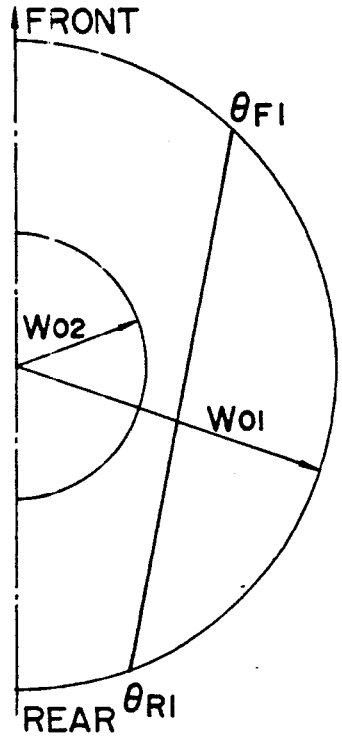
FIG. 10(*a*) is a diagrammatic view showing a rated load curve when a second inflection angle is not set, and FIG. 10(*b*) is a similar view but showing a rated load curve when a second inflection angle is set.
Figure 10B:
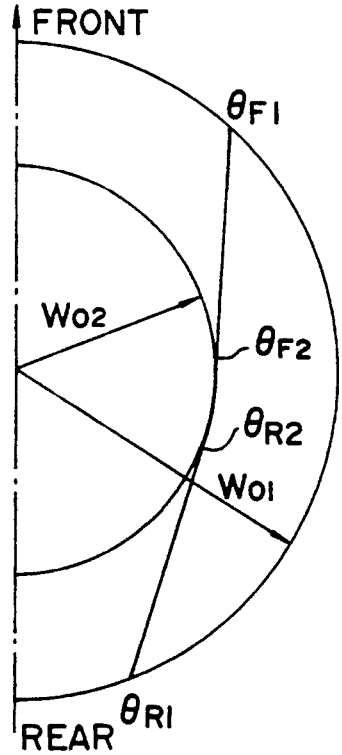

Criteria in such setting will be described subsequently. When points on an arc having a radius of the first rated load $W_{01}$ described above corresponding to the first inflection angles $\theta_{F1}$ and $\theta_{R1}$ is interconnected by a straight line, there exist two cases including a first case wherein the straight line crosses another arc having a radius of the second rated load $W_{02}$ as shown in FIG. 10(*a*) and a second case wherein the straight line does not cross the latter arc. In case the straight line does not cross the arc, the straight line is set as it is as a boundary between the left and right regions. On the other hand, in case the straight line crosses the arc having the radius of the second rated load $W_{02}$, angles corresponding to contact points of tangential lines drawn to the arc from points corresponding to the individual first inflection points $\theta_{F1}$ and $\theta_{R1}$ as shown in FIG. 10(*b*) are set as second inflection angles $\theta_{F2}$ and $\theta_{R2}$.

While a way of thinking in setting each inflection point is such as described above, when calculation is to be performed actually, a compression $\lambda o$ which makes an boundary between whether such a boundary line as shown in FIG. 10(*a*) is to be made or whether such a boundary line as shown in FIG. 10(*b*) is to be made is stored into the inflection angle calculating means 245, and as for compressions higher than the boundary compression $\lambda o$, individual compressions $\lambda$ and second inflection angles corresponding to the outrigger jack modes should be stored.

Figure 11:
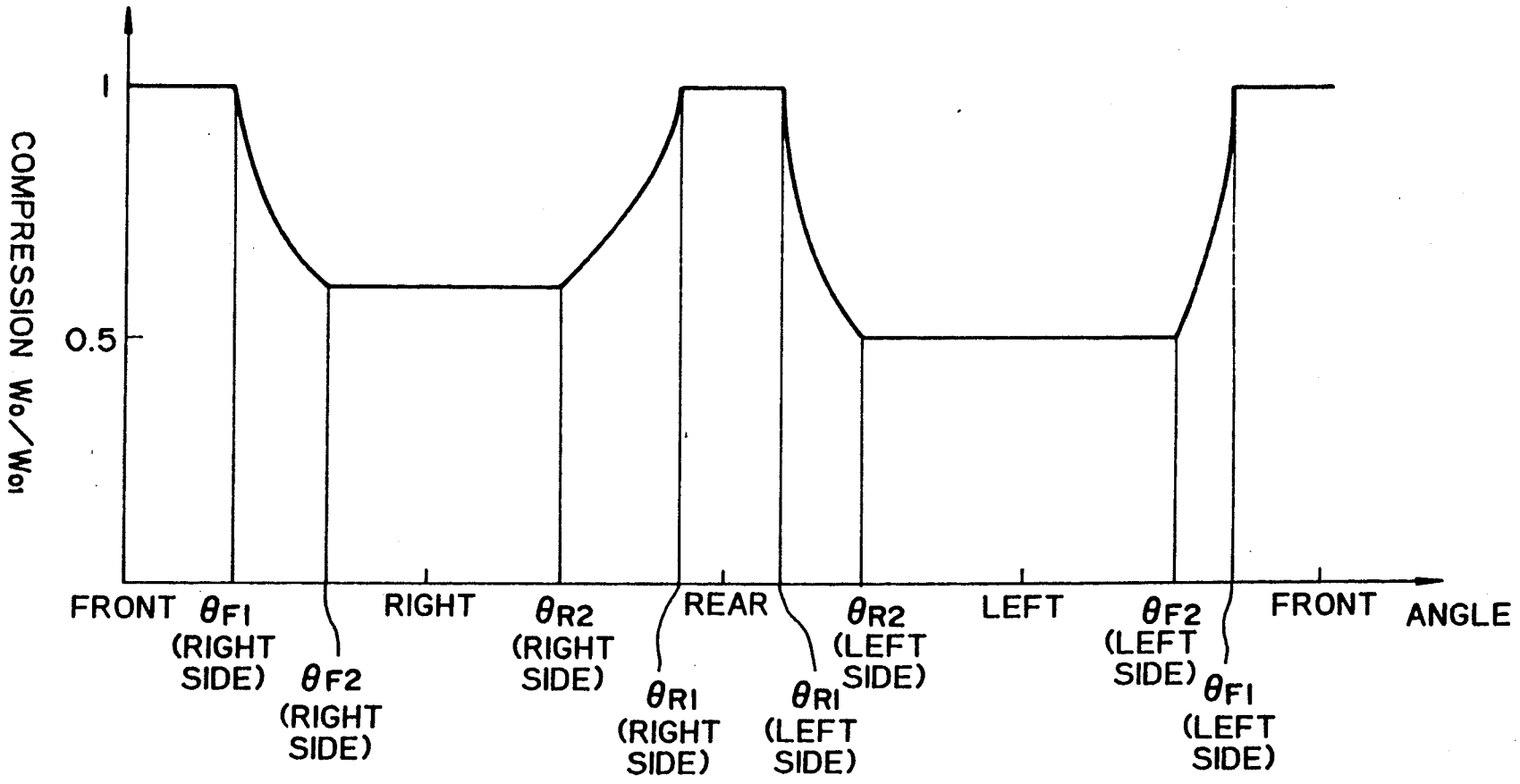
FIG. 11 is a graph showing a compression set for the entire circumference.

After inflection angles are set in this manner, a ratio $Wo/W_{01}$ between the rated load Wo in a region in which a boundary line is a straight line and the first rated load $W_{01}$, or in other words, an intermediate compression, is found out by interpolation calculation in accordance with the first rated load $W_{01}$ and the second rated load $W_{02}$ by the interpolation calculating means 246 (step S7). Consequently, such a compression $Wo/W_{01}$ over the entire circumference as shown by the graph of FIG. 11 is found out. A rated load over the entire circumference is set in accordance with the entire circumference compression by the rated load setting means 247 (step S8), thereby completing a setting operation of a rated load curve.

Setting of an entire circumference rated load based on the operating radius R can be recognized from such a three-dimensional graph drawn on a cylindrical coordinate system of R-$\theta$-Wo. A three-dimensional face SF shown in the graph indicates a rated load Wo corresponding to a different operating radius R and a revolving angle $\theta$, and an unstable region of the three dimensional face SF sidewardly of the vehicle body makes such a concave face SS as shown on the front of FIG. 7 when, for example, the left front and left rear outrigger jacks 105 are in the condition of intermediate 2. Accordingly, a crossing line (closed curve) RP between the three-dimensional face SF and a cylinder CY having a radius equal to the operating radius R at present makes a rated load curve to be found.

Figure 12:
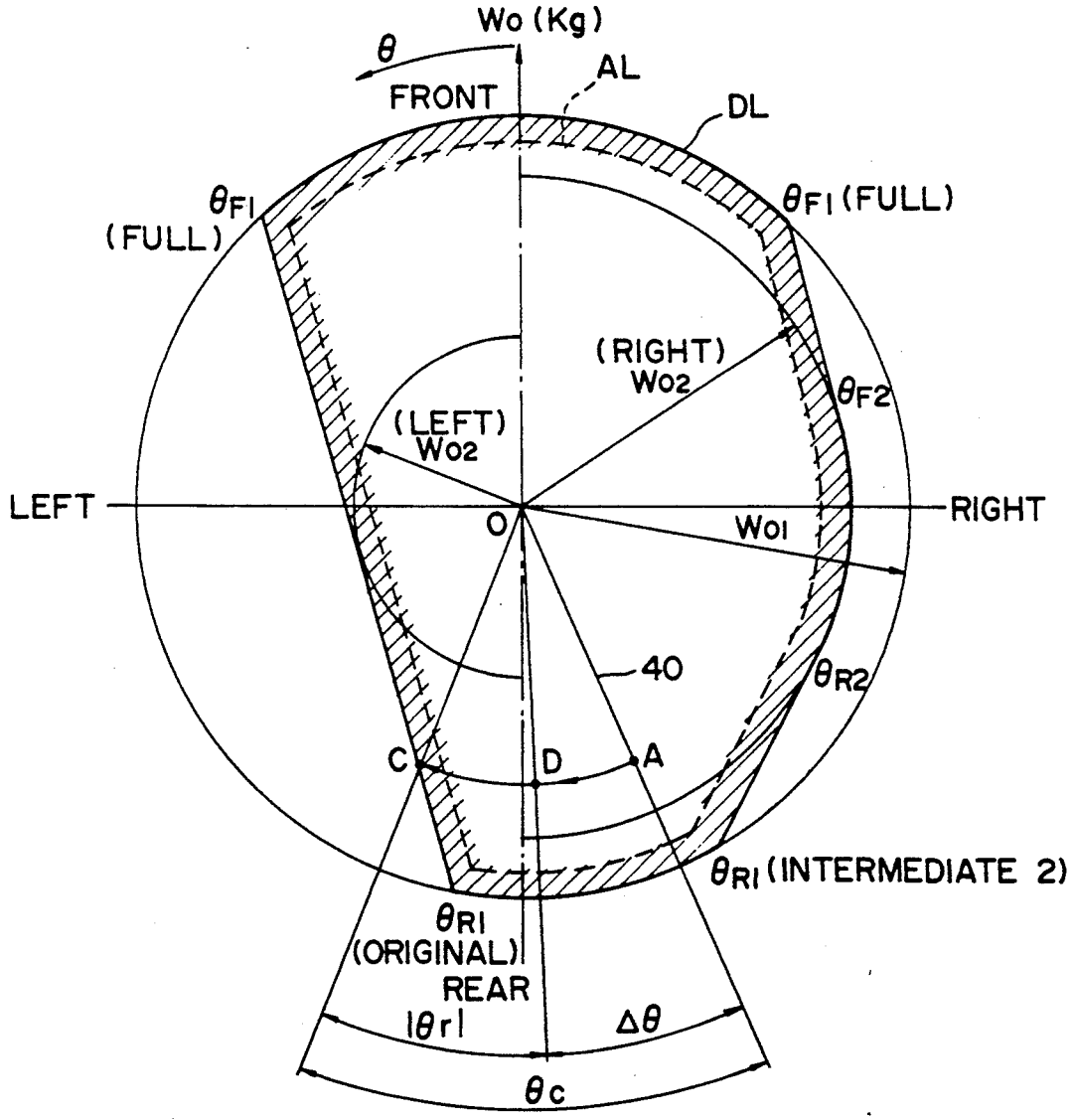
FIG. 12 is a diagrammatic view showing a rated load curve set by the calculating and controlling unit of FIG. 1.

FIG. 12 shows an exemplary rated load curve set in such a manner as described above. Referring to FIG. 12, DL denotes a rated load curve, and the region surrounded by the rated load curve DL, that is, the region indicated by slanting lines, makes a safety operating region. As can be seen from FIG. 12, in the equipment of the present embodiment, the rated load curve DL is set differently for the opposite left and right sides, and setting which takes also a difference between the horizontal extension amounts of the front and rear outrigger jacks 105 into consideration is made. Besides, the rated load curve DL continues over the entire circumference and has a profile which is composed of arcs and straight lines which can be grasped readily by a user. Further, the point A indicates an actual load and an actual revolving angle at the present point of time as hereinafter described, and an actual operation situation within the operating region can be recognized at a glance from a line segment OA (line segment 40).

Meanwhile, the braking angle acceleration calculating means 26 calculates, by way of the following procedure, a braking angle acceleration $\beta$ which takes a lateral bending strength of the boom B into consideration and does not cause swinging of a load.

First, the boom inertial moment calculating means 261 calculates inertial moments In of the individual boom members Bn in accordance with the following equation:

$$In=Ino\cdot\cos^2\phi+(Wn/g)\cdot Rn^2$$

where Ino is an inertial moment (constant) of each boom member Bn around the center of gravity, and Wn a weight of each boom member Bn, g the gravitational acceleration and Rn a revolving radius of the center of gravity of each boom member Bn.

The allowable angular acceleration calculating means 262 calculates an allowable angular acceleration $\beta_1$ in the following manner.

Generally, while the boom B and the boom hoot 102 of the crane 10 have sufficient strengths, if the boom length LB increases, then a high lateral bending force acts upon the boom B due to an inertial force which occurs upon braking to revolving movement. Since the burden in strength by a lateral bending force presents its maximum in the neighborhood of the boom foot 102, evaluation of the strength is executed here in accordance with a moment around the shaft 101.

If it is assumed that the angular acceleration of the boom B upon braking to revolving movement is represented by $\beta'$ and the revolving angular acceleration of the suspended load C is represented by $\beta''$, then a moment $N_B$ which acts upon the center of revolving motion during revolving movement of the boom B is represented by the following Equation 1:

$$NB = (W/g)\, R^2\, \beta'' + \sum_{n=1}^{N} In\, \beta' \tag{1}$$

where W is a hoisting load calculated by the hoisting load calculating means 22. Meanwhile, if a rated load regarding a lateral bending strength of the boom B is represented by Wo' (=Wo·α', where α' is a safety factor), then an allowance requirement regarding the strength is represented by the following Equation 2'':

$$N_B/R_B \leqq Wo' \tag{2}$$

where $R_B = L_B \cos \phi$.

Substituting Equation 2 into Equation 1, the following Equation 3 is obtained:

$$(W/g)\, R^2\, \beta''/R_B + \sum_{n=1}^{N} In\, \beta'/R_B \leqq Wo' \tag{3}$$

Accordingly, a maximum angular acceleration $\beta'$ which satisfies Equation 3 should be set to an allowable angular acceleration $\beta_1$. It is to be noted that, while the rated load Wo' may be set to a fixed value, it may otherwise be set, taking a deflection of the boom B and so forth into consideration, to a value which decreases as the boom length LB and the operating radius R increase.

The actual angular acceleration calculating means 263 calculates an actual braking angular acceleration $\beta$ in accordance with the allowable angular acceleration $\beta_1$ calculated in this manner and the boom angular velocity (angular velocity before deceleration) Ωo and the load swinging diameter 1 calculated from the results of detection of the angular velocity sensor 16 and the rope length sensor 17.

Figure 13:
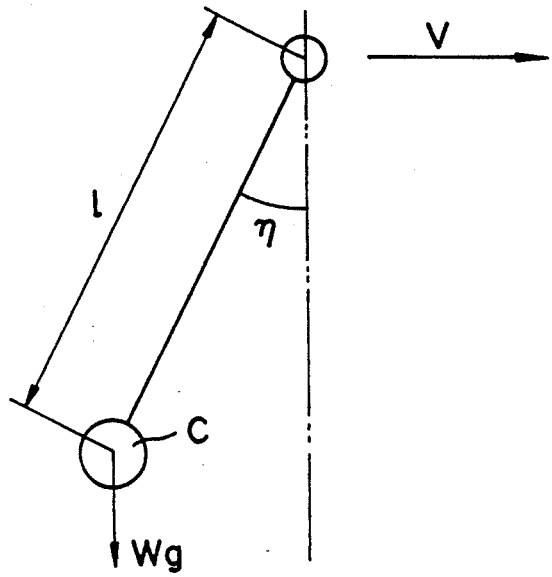
FIG. 13 is a diagrammatic view illustrating a condition of a hoisting load as a simple pendulum.

A manner of calculation of them will be described subsequently. First, such a model of a simple pendulum as shown in FIG. 13 is considered with regard to the suspended load C suspended on the crane 10. Differential equations of the system are given by the following Equation 4 and Equation 5:

$$\ddot{\eta} = (g/l)\eta = -\dot{V}/l \tag{4}$$

$$V = Vo + at \tag{5}$$

where $\eta$ is a swinging angle of the suspended load C, V a revolving velocity of the boom point which varies together with the time t, Vo a revolving velocity (=RΩo) of the boom point before starting of stopping of revolving movement, and a an acceleration of the boom point. Differentiating the opposite sides of the Equation 5 by the time t, substituting the same into the right side of the Equation 4 and integrating the same under the initial conditions (t=0 and $\eta=0$, $d\eta/dt=0$), the following Equation 6 is obtained.

$$(\eta + a/g)^2 + (\dot{\eta}/\omega)^2 = (a/g)^2 \tag{6}$$

where $\omega = \sqrt{g/l}$.

Figure 14:
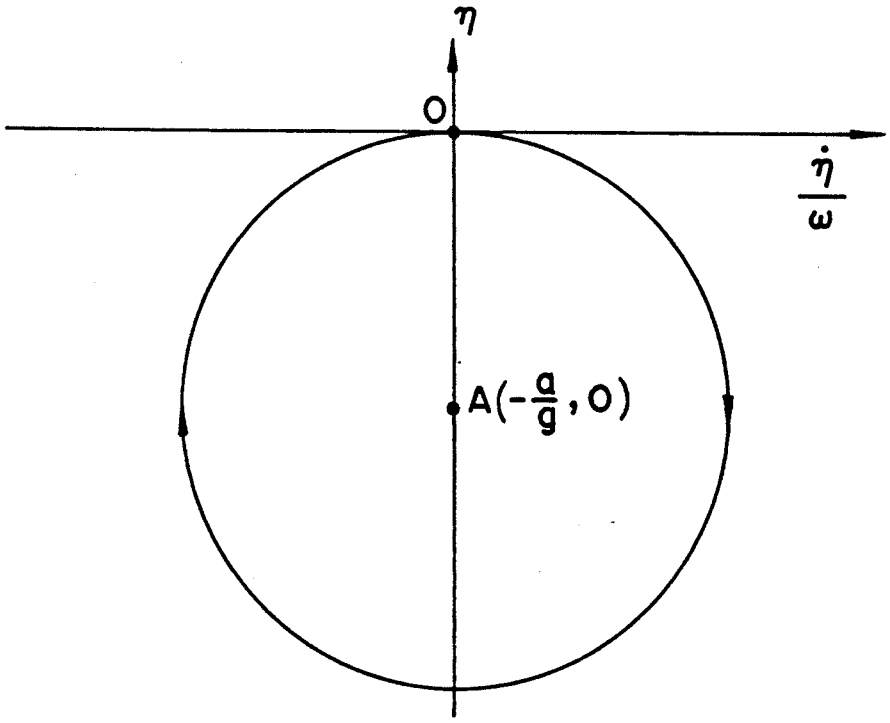
FIG. 14 is a graph illustrating an equation regarding a swinging angle and a swinging velocity of the hoisting load on a phase space.

If Equation 6 is represented on a phase plane regarding $(d\eta/dt)/\omega$, then a circle which is centered at the point A (−a/g, 0) and passes the origin O (0, 0) is drawn as shown in FIG. 14. A time required to travel along the circle once, that is, a period T in which the simple pendulum returns to the origin O after leaving there, is given by $T = 2\pi/\omega$, and accordingly, if the angular acceleration $\beta$ is set so that the crane may be stopped completely in the time nt (n is a natural number) from the point of time at which stopping of revolving movement of the crane is started (point O), then the crane can be stopped while swinging movement of the suspended load is not left upon stopping. Meanwhile, since the value $\omega$ is a fixed value which depends upon the gravitational acceleration g and the swinging diameter 1, the angular acceleration $\beta$ at which stopping of revolving movement without leaving swinging movement of the suspended load can be achieved is given by the following equation:

$$\beta = -\Omega o/nT = -\omega \Omega o/2n\pi$$

where n is a natural number.

Meanwhile, as for the lateral bending strength of the boom B, since $|\beta| \leqq \beta_1$ is the requirement, if a minimum natural number is selected from within a range in which the requirement is satisfied, then an actual braking angular acceleration $\beta$ to stop the crane without leaving swinging movement of the suspended load in a necessary minimum time can be obtained. The required angle calculating means 27 calculates, based on the current angular velocity (i.e., angular velocity before braking) Ωo, a revolving angle (required angle) θr necessary before the boom B is stopped completely after starting braking when stopping of revolving movement of the boom B is tried to be stopped at the braking angular acceleration $\beta$. More particularly, where a required time before complete stopping is reached after starting braking is represented by t, then the following two equations $$\Omega o + \beta t = 0$$

$$\theta r = \beta t^2/2 + \Omega o t$$

stand, and accordingly, the required angle θr can be obtained by eliminating t from the two equations.

The marginal angle calculating means 28 calculates an angle over which the boom B can be revolved at the current angular velocity Ωo before braking is started, that is, a marginal angle Δθ (=θc−θr). For example, if the position at which braking must be started in order to achieve stopping at the position C is represented by D in FIG. 12, then the marginal angle Δθ is an angle defined by the straight lines OA and OD.

The second stopping controlling means 294 outputs, at a point of time when the calculated marginal angle Δθ is reduced to 0, for example, at a point of time when the boom B arrives at the position D in FIG. 12, a controlling signal to the hydraulic circuit 33 to effect compulsory stopping of revolving movement and also of an operation of the boom B in which the operating radius increases from that at the present point of time. In this instance, in order to prevent swinging movement of the suspended load C, the second stopping controlling means 294 sets a hydraulic motor pressure $P_B$ so that the boom B may be stopped at the braking angular acceleration $\beta$.

An example of a manner of calculation of the hydraulic motor pressure $P_B$ will be described subsequently. Now, if a sum total of inertial moments regarding members of the upper revolving member other than the boom B is represented by Iu, then a torque required for braking to revolving movement is given by the following Equation 7:

$$TB = |(W/g)R^2\beta'' + \sum_{n=1}^{N} In\beta + Iu\beta| \quad (7)$$

where $\beta''$ is an acceleration of the suspended load C. The acceleration $\beta''$ can be represented by the following equation by solving Equation 3 and Equation 5 for the initial conditions of $t=0$, $\eta=0$ and $\eta t/dt=0$ though not described in detail:

$$\beta''=(1-\cos \omega t)\cdot\beta$$

Meanwhile, the torque $T_B$ generally has such a relationship as given by the following Equation 8 to conditions of the hydraulic motor side though not described in detail:

$$T_B=(P_B\cdot Q_h/200\pi)i_o/\eta_m \quad (8)$$

where $Q_h$ is a capacity of the hydraulic motor, $i_o$ a total reduction ratio, and $\eta_m$ a machine efficiency.

Accordingly, substituting the Equation 8 into the Equation 7 above, an actual hydraulic motor pressure $P_B$ can be obtained.

On the other hand, the second alarm controlling means 293 outputs, at a point of time when the marginal angle $\Delta\theta$ is reduced not to 0 but to a value lower than a predetermined value, a controlling signal to the alarm 31 to effect alarming. Consequently, the operator can become aware that braking will be automatically applied after revolving movement by a small amount after then.

Further, the calculating and controlling unit 20 outputs information signals of the various values to the display unit 32 so that, in addition to such a rated load curve DL and a line segment 40 indicative of both of a load W and a revolving angle $\theta$ at present as shown in FIG. 12, extended positions of the outrigger jacks 105, an equal load factor curve AL interconnecting positions of a fixed load factor (90% in FIG. 12) and so forth are displayed on the display unit 32. Consequently, the operator can grasp it at a glance from the rated load Wo how much margin the operating condition at present has.

In this instance, since the rated load curve DL is set to a regular closed curve which continues over the entire circumference, the operator can grasp the operation allowance region readily comparing with the case wherein an irregular rated load curve which cannot be forecast by the operator is set as in the prior art. Besides, since setting of a rated load is performed which takes horizontal extension amounts of the front and rear outrigger jacks 105 into consideration, the safety of the machine is assured with certainty.

It is to be noted that, while a first rated load $W_{01}$ and a second rated load $W_{02}$ are calculated separately from each other in the embodiment described above, the present invention is not limited to this, and for example, the second rated load $W_{02}$ may be calculated based on the first rated load $W_{01}$ and a compression $\lambda$ which corresponds to an outrigger jack mode and is stored in the sideward capacity calculating means. Further, a line interconnecting an arc having a radius of the first rated load $W_{01}$ and another arc having another radius of the second rated load $W_{02}$ is not limited to a straight line, but may be set, for example, to a curve or the like the distance of which from the central point 0 increases in proportion to the revolving angle $\theta$ from the first rated load $W_{01}$ to the second rated load $W_{02}$.

Further, while a crane wherein the outrigger jacks 105 are provided at the front and rear of the vehicle body and are extended leftwardly and rightwardly is illustrated in the embodiment described above, it may otherwise be of the type wherein they are extended obliquely to the left and right of the vehicle body radially from the center axis of revolving movement. Further, the present invention can be applied to a crane such as a crawler crane wherein, while no outrigger jack is provided, left and right crawlers can be extended and the crane is used while the crawlers are in a retracted condition only on one side or on the both sides.

Further, the present invention can be applied to a construction equipment wherein a safety operation is controlled in accordance with a rated load, and detailed contents of its safety operation does not matter. For example, it may be, in addition to such an alarm or a compulsory stopping operation as described above, a display to urge attention of an operator, and an operation of the first operating means may be a displaying operation of a load factor.

Having now fully described the invention, it will be apparent to one of ordinary skill in the art that many changes and modifications can be made thereto without departing from the spirit and scope of the invention as set forth herein.

What is claimed is:

1. A safety apparatus for a construction equipment which includes a revolvable upper revolving member and a plurality extendible support members and wherein a hoisting load is suspended at a predetermined position of said upper revolving member, comprising:

hoisting load detecting means for detecting a hoisting load to said upper revolving member;

operating radius detecting means for detecting an operating radius of said upper revolving member;

revolving angle detecting means for detecting a revolving angle of said upper revolving member;

support member detecting means for detecting a horizontal extension amount of each of said support members;

entire circumference rated load calculating means for calculating rated loads of said upper revolving member in accordance with the operating radius and the horizontal extension amounts of said support members for different revolving angles and setting a rated load curve over the entire circumference;

load factor calculating means for calculating a load factor in accordance with the rated load calculated by said entire circumference rated load calculating means;

first operating means for performing a safety operation in accordance with the load factor calculated by said load factor calculating means; and second operating means for performing a safety operation in accordance with the rated load curve set by said entire circumference rated load calculating means and an actual hoisting load and an actual revolving angle of said upper revolving member; and wherein said entire circumference rated load calculating means includes forward capacity calculating means for calculating a first rated load of said upper revolving member with regard to the forward and backward direction, sideward capacity calculating means for calculating second rated loads of said upper revolving member individually with regard to the left and right sides in accordance with extended conditions of said support members, and rated load setting means for setting a rated load curve, which continues over the entire circumference, in accordance with the first rated load, the second rated load and the extended conditions of the individual support members.

* * * * *